US010137059B2

(12) United States Patent
Brown et al.

(10) Patent No.: US 10,137,059 B2
(45) Date of Patent: Nov. 27, 2018

(54) NURSING BOTTLE WITH INTEGRATED COLLAR AND NIPPLE FLANGE VENTING STRUCTURE

(71) Applicants: Craig E Brown, Chesterfield, MO (US); Robert J Brown, Chesterfield, MO (US)

(72) Inventors: Craig E Brown, Chesterfield, MO (US); Robert J Brown, Chesterfield, MO (US)

( * ) Notice: Subject to any disclaimer, the term of this patent is extended or adjusted under 35 U.S.C. 154(b) by 0 days.

(21) Appl. No.: 15/330,352

(22) Filed: Sep. 9, 2016

(65) Prior Publication Data

US 2017/0007504 A1 Jan. 12, 2017

Related U.S. Application Data

(63) Continuation-in-part of application No. 14/999,549, filed on May 23, 2016, and a continuation-in-part of application No. 14/120,758, filed on Jun. 24, 2014, which is a continuation of application No. 13/065,411, filed on Mar. 22, 2011, now abandoned, and a continuation-in-part of application No. 12/321,455, filed on Jan. 21, 2009, now Pat. No. 8,113,365.

(Continued)

(51) Int. Cl.

| | |
|---|---|
| ***B67D 3/00*** | (2006.01) |
| ***A61J 11/02*** | (2006.01) |
| ***A61J 11/04*** | (2006.01) |
| ***B65D 47/32*** | (2006.01) |

(52) U.S. Cl.

CPC ..... *A61J 11/02* (2013.01); *A61J 11/04* (2013.01); *B65D 47/32* (2013.01)

(58) Field of Classification Search

CPC ..... A47G 19/2266; A61J 11/02; A61J 11/04; B65D 47/32

USPC ..... 222/188, 478

See application file for complete search history.

(56) References Cited

U.S. PATENT DOCUMENTS 2,061,477 A 11/1936 Perry
2,156,313 A 5/1939 Schwab (Continued)

*Primary Examiner* — Patrick M Buechner
*Assistant Examiner* — Michael J Melaragno
(74) *Attorney, Agent, or Firm* — Paul M. Denk

(57) ABSTRACT

A vent prevents a vacuum from forming within an inverted container of liquid when the liquid is dispensed. The vent is a singular vent, formed of a vent tube, the vent tube removably secures with a nipple, and more particularly its radially extending flange, with the nipple flange having a passage therethrough to allow for venting by way of the vent tube from the interior of the container to the location between the container neck and its collar, to provide for the entrance of atmospheric air into the interior of the container during usage to prevent the generation of any vacuum therein. The container may be a nursing bottle, with its collar and nipple applied to the top, and the vent tube being secured to the bottom of the nipple flange for projecting downwardly within the bottle to perform its venting function. The bottle may be formed of fully or partially transparent material, tinted to one or more coloration, while the vent tube may be tinted to one or more different coloration, and when they are assembled, exhibits three or more colorations for the vent tube when viewed from exteriorly of the tinted nursing bottle during its application.

6 Claims, 3 Drawing Sheets

Related U.S. Application Data

(60) Provisional application No. 62/234,408, filed on Sep. 29, 2015, provisional application No. 62/230,082, filed on May 27, 2015, provisional application No. 61/340,993, filed on Mar. 25, 2010, provisional application No. 61/062,754, filed on Jan. 29, 2008.

(56) References Cited

U.S. PATENT DOCUMENTS

| | | | | |
|---|---|---|---|---|
| 2,239,275 | A | 4/1941 | Schwab | |
| 2,744,646 | A | 5/1956 | Blackstone | |
| 2,753,067 | A * | 7/1956 | Rodriguez | A61J 9/008 215/11.1 |
| 3,168,221 | A | 2/1965 | Parker | |
| 3,722,728 | A * | 3/1973 | Yazaki | A61J 11/02 215/11.4 |
| 5,449,098 | A | 9/1995 | Offman | |
| 5,570,796 | A | 11/1996 | Brown et al. | |
| 5,678,710 | A | 10/1997 | Sheu | |
| 5,779,071 | A | 7/1998 | Brown et al. | |
| 5,791,503 | A | 8/1998 | Lyons | |
| 7,172,086 | B2 | 2/2007 | McKendry et al. | |
| 7,828,165 | B2 | 11/2010 | Brown et al. | |
| 8,113,365 | B2 | 2/2012 | Brown et al. | |
| 2005/0258124 | A1 | 11/2005 | Brown et al. | |
| 2006/0124573 | A1 * | 6/2006 | Nachumi | A61J 9/006 215/11.5 |
| 2006/0213859 | A1 * | 9/2006 | Sheu | A61J 9/006 215/11.5 |
| 2007/0045214 | A1 * | 3/2007 | Jennings | A61J 11/02 215/11.1 |
| 2008/0099422 | A1 * | 5/2008 | Rees | A61J 9/006 215/11.5 |
| 2009/0200257 | A1 | 8/2009 | McKendry et al. | |

* cited by examiner

NURSING BOTTLE WITH INTEGRATED COLLAR AND NIPPLE FLANGE VENTING STRUCTURE

CROSS REFERENCE TO RELATED APPLICATION

This application claims priority to the provisional patent application having Ser. No. 62/234,408 filed on Sep. 29, 2015, which is a continuation-in-part of the patent application having Ser. No. 14/999,549, filed May 23, 2016, which claims priority to the provisional patent application having Ser. No. 62/230,082, filed on May 27, 2015; and this application is a continuation-in-part patent application upon the non-provisional patent application having Ser. No. 14/120,758, filed on Jun. 24, 2014, which application is a continuation of the non-provisional patent application having Ser. No. 13/065,411, filed on Mar. 22, 2011, and which claims priority upon the provisional application having Ser. No. 61/340,993, filed on Mar. 25, 2010; which previous non-provisional claims priority to the pending non-provisional application having Ser. No. 12/321,455, filed on Jan. 21, 2009, and which application claims priority upon its provisional application having Ser. No. 61/062,754, filed on Jan. 29, 2008.

FIELD OF THE INVENTION

This invention relates to a vent that prevents the creation of a vacuum inside of a container, particularly a nursing bottle, which includes venting structure assembled from very few components, such as the flange of its nipple and a venting tube, to furnish a venting of such a bottle, and because there are so few components involved, they are easy to disassemble, clean, and reassemble for immediate usage in the feeding of formula to an infant. Also, select parts may be disposable. The invention further relates to a variable color designs for a nursing and other bottle.

BACKGROUND OF THE INVENTION

The applicants herein have a history of designing vented containers, particularly nursing bottles, and have obtained significant commercial success in the marketing of these products. In particular, the essence of the invention is to give consideration to the provision of venting of such a container, so that when a liquid is consumed, from therein, it is free of aeration or bubbles, does not require sucking by the infant when drinking from the nursing bottle, and furthermore, contains significantly reduced parts that can be easily cleaned, during application and usage.

The concept of this improved current invention is to even further reduce the number of parts required to attain a venting of the bottle when there is consuming of its liquids, and particularly of a nursing bottle during usage, when used for feeding infants and small children.

Prior art containers, other than the applicants' prior inventions and patents, that hold and pour liquids have the disadvantage of usually leaking, introducing air into the liquid, not pouring on demand, not venting the container, and not providing a balanced pressure inside the container, so that withdrawal of the liquids is on demand from their containers. In addition, many of the prior art utilize either direct venting, which means that any fluids located within the vent tube will pour freely from the container, in which the vent structure is installed, only to create a mess for the infant if it is drinking from a nursing bottle, containing such early venting structures.

Frequently, in order to lessen leakage, many prior art vents require a particular orientation of the container, generally in an upward position, and such can be seen in the prior United States patent to Parker, U.S. Pat. No. 3,168,221, upon a vent means for bottles and jugs. If the vent therein is not oriented correctly, a significant amount of liquid is spilled from the vent to the outside of the container, and typically onto the user of the container, especially if it is an infant consuming a formula.

As stated, the applicants have successfully designed a venting system that alleviates the leakage problems as previously referred to, through the use of a double venting structure, as can be noted in their U.S. Pat. No. 5,779,071, upon a nursing bottle with an air venting structure. As can be seen therein, the double venting concept is attained through use of a vent insert, which is a downwardly extending vent tube, and then incorporates a reservoir with a reservoir tube, that fits over the vent tube, so that when the bottle is inverted, any fluid remaining within the reservoir tube fills into the shown reservoir, and above the bottom of the inverted vent tube, when the bottle is turned, to thereby prevent the leakage of any formula to the exterior, and at the same time, prevent the generation of any negative pressure within the inverted bottle, when the formula is being extracted and consumed. Similar type structure can be seen in the applicants prior related U.S. Pat. No. 5,570,796, again upon a nursing bottle with an air venting structure.

The applicants have obtained a variety of other patents upon various types of vented nursing bottles, as can be seen in their U.S. Pat. No. 8,113,365, showing a fully vented nursing bottle with single piece vent tube. Other related structures can be seen in their U.S. Pat. No. 7,828,165, in addition to Publication No. US 2005/0258124, upon a fully vented wide rimmed nursing bottle with contoured vent tube. Further related structures can be seen in the patent to the inventors herein, as noted in U.S. Pat. No. 7,828,165.

As stated, the concept of this current invention is to even further reduce the number of components that make up the venting system for a container, particularly a nursing bottle, through the integration of select related structures, as modified, to the venting system when installed within particularly a nursing bottle, or with any container.

There are other examples of prior art that show nursing bottles, even some with a form of venting structure, as can be seen in the United States patent to Perry, U.S. Pat. No. 2,061,477, which shows a form of vent structure. But, it is believed that leakage occurs when the bottle is inverted because its shown vent tube directly communicates with its lateral ports, in the region of the neck of the shown bottle.

The patent to Schwab, U.S. Pat. No. 2,156,313, shows a fairly complex form of dispensing and package device for fluids. This shows a pair of vent tubes, but it would appear when the device is inverted, whatever liquid may be contained within the shorter vent tube will be discharged, until the bottle is emptied. Another patent to Schwab, U.S. Pat. No. 2,239,275, shows a further self-contained liquid dispensing device. Apparently this device is designed for providing venting, through its complex venting structure, as can be noted, when the device is inverted, and liquid is dispensed from its tube, as can be seen.

The patent to Blackstone, U.S. Pat. No. 2,744,646, shows another form of bottle construction, that incorporates a vent tube. But, the vent tube empties directly to the outside, which means it will leak when the bottle is inverted for consumption of its contents.

The patent to Offman, U.S. Pat. No. 5,449,098, shows a fluid flow controller for a bottle. This device is apparently for use with a soda or other fluids bottle, and does have a reservoir in an effort to collect the vent tube fluids when the bottle is inverted, as shown. But, unless that bottle is oriented in a particular direction, it will leak its fluids from the vent tube, and its reservoir, when it is initially inverted.

The patent to Sheu, U.S. Pat. No. 5,678,710, shows another nursing bottle, and its nipple design, where it simply has a vent tube that sticks partially down into the fluids. Obviously, when that bottle is inverted, and the tip of its vent tube is within the liquid, there will be substantial leakage.

The patent to McKendry, U.S. Pat. No. 7,172,086, shows a further vented and double walled baby bottle. Apparently this device includes a check valve, to try to prevent leakage from the bottle when inverted, as during usage. This prevents natural discharge of the fluid and is susceptible to breakage and leakage.

These are examples of what prior art are known, and which are designed for venting of a nursing and other bottles, but they are far more structurally complex of design, and obviously will have difficulty of cleaning, after usage, many designs will contaminate the fluid with air and will not naturally flow, whereas, the concept and design of the current invention is to simplify the structure and to provide a least number of parts, to make up a venting structure, particularly within a nursing bottle, that can be very easily cleaned after usage, and quick to reassemble, when prepared for reception of a formula, and used by the infant during feeding and consumption of its contents.

As is also well known, babies should drink from vented containers in order to physiologically simulate breast feeding. This prevents air ingestion and formation of a vacuum in the container, which allows feeding on demand, and minimizes the consequences of feeding against a vacuum, which can include increased ear infections, gas, colic, irritability, ear fluid accumulation, speech delays, vitamin degradation, as well as other known maladies. Currently, if vented, infant feeding containers utilize multiple components to vent the container, as referred previously in the prior art, or modify the feeding nipple to some extent. Some utilize feeding bags in the nursing bottle. These components are sold with the container and are expensive and difficult to clean. Many caregivers simply purchase ordinary unvented or undervented bottles due to the cost and increased time and inconvenience of cleaning the container and its multitude of parts, as shown in the prior art. The undervented bottles require formation of a vacuum in the container in order to draw the air into the container and to partially and temporarily release the vacuum that is generated therein. The unvented container requires formation of a very significant negative pressure by the sucking by infant in order to withdraw the liquid and formula, from the unvented container, which also causes contamination of the liquid with air. This can generate aeration within the formula, which can lead towards the development of colic in the infant. Such can also cause other impairments. The bag systems and check-valve systems also require the generation of a negative pressure formation by the infant to overcome that pressure formed in the container. As is well known in the medical literature, and by the moms, that the breast supplies a positive pressure to the milk being emitted. All of the current art feeding container are not physiologic or healthy for the infant, with the exception of the prior bottles of the current inventors, which were double vented. Frequently, cleaning is difficult to do and the parts are lost or damaged, which is very expensive and frustrating for the user. If the system uses check-valves, which are very common, these check-valve are very difficult to clean and frequently suffer from significant or complete failure from their fragile texture and nature. Of note, is that some of the prior art utilizes a venting port in the cap that is aligned with the vent extending typically several centimeters into the container. This obviously does not provide true venting and there is no positive pressure, and also suffers from air contamination of the liquid in the container, since negative pressure must first be initiated and used to draw the liquid from the container. Thus, all of the unhealthy and negative aspects of partial venting are noted with these prior art. Also, with this type of prior art, where a check-valve is used, with all of its negative attributes, the oral negative pressure must be generated in order to withdraw liquid from the container during its initial and continued usage.

In the prior art, there is no option to obtain a venting portion of the bottle, and to use the same with the standard bottles that were already purchased and possessed. Also, there is not any system that is both disposable and cleanable. This option is particularly useful for those users that wish to utilize a feeding system differently for different situations. An example of this is when a user wishes to clean and reuse the vent when at home, but desires to dispose of the vent when traveling and cleaning is difficult, and the current invention accommodates this. Currently, there just is not any system that fully vents and allows the user to decide when to clean and reuse the parts, or dispose of any parts economically. Additionally, current systems frequently leak and some require the purchase of difficult to assemble and use structures, including the expensive plastic bags, that are hard to apply and remove. Also, there just is no system that allows the user to use different colored and size venting tubes, to customize the feeding container, maintain a consistent flow rate, and to experience consistency in the usage and application of the vented nursing bottle, as to be subsequently described herein.

There are other related vented baby bottles, such as can be seen in the United States published application No. U.S. 9009/0200257, that shows a vented container with a check-valve to prevent its leakage. A nursing bottle with anti-air ingestion valve can be seen in the U.S. Pat. No. 5,791,503, that discloses a very large check-valve across the superior aspect of the container. Finally, a vented and double walled baby bottle, as shown in U.S. Pat. No. 7,172,086, shows a double walled container with a check-valve system.

The current invention is designed to provide a venting system for a nursing bottle, using the least number of parts over anything shown in the art, incorporates no check-valve system, to attain an internal venting of the bottle structure, during consumption of its liquid and formula.

These are all examples of what prior art are known, and which are designed for venting of a nursing bottle or other container, but they are far more structurally complex of design, and obviously will have difficulty of cleaning, after usage, whereas, the concept and design of the current invention is to provide the least number of parts, to make up a venting structure, particularly within a nursing bottle or any other container, that can be very easily cleaned after usage, and prompt to reassemble, when prepared for reception of a formula, and used by the infant during feeding and consumption of its contents.

SUMMARY OF THE INVENTION

This current invention provides a physiological solution for the feeding of an infant, and is an attempt to only slightly modify the existing structure of nursing bottles, but yet provide a leak proof form of venting, from a minimum of components, that make up the nursing bottle structure. Through the use of this invention, it provides a full-time, on-demand feeding, without air bubble generation, without vacuum exposure and with the option of either cleaning and reusing its components, or disposing of select of its parts, after usage. Furthermore, as an option, various colorations can be added to the venting tubes of this design, in order to furnish different colors and patterns, for the benefit and enticement of the infant. The current invention provides full venting without the use of any check-valve or any other device that prevents physiological feeding, and only uses a single additional part, other than the usual components of the nursing bottle, including the bottle, its flanged nipple, and its threaded collar. This arrangement solves the numerous problems, and all of the problems of the prior art. An easy, economical and cleanable one-piece system is provided for the caregiver, and an optimal physiological feeding is provided for the infant.

The current invention is quite simple, has less parts, is far more cost-effective, easier to manufacture, easier to use, easier to clean, and may be used with existing bottle parts, where only the flange of the nipple needs to be slightly modified, to provide for better functionality, coloration pattern, the flow rate customization, a nursing bottle that does not leak, all in a novel and inventive manner. The changeable venting tube allows for fashionable customization of the feeding container. Furthermore, the changeable venting tubes can be reused, but because of their minimum cost, may be disposable after application. Being able to change the coloration of the venting tube has the further attribute of teaching colors to the child, or color combinations, or even where the venting tube may be of one color and the nursing bottle of another color, wherein the combined container and vent tube may generate a third color, for easy identification of the bottle by all of the caregivers, whether it be the mother, family, or even at a nursery. Such can prevent the application of the wrong container to the wrong child, and minimizing the risk of exposure to multiple bacteria, viruses, and other pathogens from other infants.

The concept of this invention can be used in combination with a nursing bottle, or even in a sports bottle, or any other fluids container, and which preferably incorporates venting, through a singular vent structure, but can significantly reduce the number of operative component parts that generally make up the venting structure for the bottle, during their assembly. Generally, the nursing bottle of the present invention provides a bottle which prevents the formation of a partial or complete vacuum inside the bottle during usage and nursing, as aforesaid. Yet, the bottle of this invention uses a minimum of component parts in order to attain the effect of single venting of the bottle structure, and yet in its functioning can still resist spills. In the design and construction of the current bottle or container, because of its significantly reduced parts, it is much easier to clean, and does attain and prevents that formation of any partial or complete vacuum within its operative structure, without requiring the use of any seals or gaskets, in its assembly. Moreover, the embodiment of this current invention is to provide specifically a nursing bottle, having a single venting structure, that does still fit within the nursing bottle, but attains its venting through a unique modification to the flange of its nipple, when applied in combination with the nursing bottle, to the neck of structured bottle.

Another aspect of this invention is the provision of the fabrication of the various components for this vented container or nursing bottle, particularly with respect to the selection of the colors given to these components, and what type of hues maybe exhibited when these components are assembled in combination during usage. By way of example, if the bottle is made of a transparent material, whether it be formed of glass, blown polymer, or any other usable material for making a container or bottle, and a vent tube, which may be fabricated to different colorations, when the bottle is assembled with its venting structure therein, it has been found that separate colors may blend into a third coloration, as is known in the art, when visually observed, as an enhancement and enticement to the user, particularly the infant and the child, when they accept formulation from the nursing bottle during usage. As is known in the art, there are many combinations of colors known in the art world, such as red, yellow, green, and blue, which when combined, give off a third coloration. Thus, the primary colors generate other coloration, and that concept is what is considered herein with respect to the molding of the bottle itself, and the vent tube, to take advantage of this phenomenon, in order to add to the visual stimulating effects of the nursing bottle, when it is assembled and used, and displays how a third coloration can be generated, from the combination of two other primary colors. It is also just as likely that multiple colors may be used in the fabrication of the vent tube, such as to give it the appearance of a stripped candy cane, or any other indicia or coloration pattern, which when located within the tinted nursing bottle, such that it will give off many other different colors, in appearance, when viewed, during usage. Learning from different color combinations is also possible for all.

Generally, the nursing bottle of the present invention comprises the standard type of nursing container, that is adapted to hold a quantity of liquid or formula, and having an opening at its top for the reception and placement of the nipple, the collar to hold it in place, and in this instance, a single venting structure that assembles internally of the collar, in combination with the flange of the nipple, when communicating with a vent tube that vents to atmosphere, along a passage provided through the nipple flange, and readily along its upper surface, for communicating with the air passages provided between the collar, and the threads of the container, when it is assembled for usage. The lower portion of the vent tube will extend to the lower regions of the bottle, so that when it is inverted, it will extend above the contained liquid line, thereby allowing the entrance of any ambient air to the upper regions of the inverted bottle, by way of its vent tube, and the passage provided along the flange of the nipple, so that during usage, it prevents the generation of any partial or complete vacuum at that location. The nipple flange, on its underside, will preferably have an integral downwardly extending sleeve, just slightly greater or equal to the diameter of the vent tube that inserts therein, for holding it in place during usage and application of this invention.

It needs to be reviewed that since the vent tube is removable from its location within the integral sleeve of the nipple, after usage, it can be removed to facilitate cleaning. Or, one of the main concepts of this invention is to use a vent tube that may be fabricated in the manner of a straw, even out of paper, or polymer, and it may be disposable after each usage. Or, where the vent tube may be formed of a more resistant polymer, or of glass, it can be removed, and cleaned, and reused, during its application for nursing purposes.

When the collar of the nursing bottle is applied, it has a tendency to come to rest upon the upper surface of the nipple flange. It will be tightened in place, but not so tight that it closes off the air vent passage provided upon said upper surface of the nipple flange, but tight enough to prevent any leakage of formula at this location, as the collar biases the nipple flange against the upper edge of the neck of the nursing bottle. And, since the collar does come to rest and forms the upper area of the flange, it effectively closes off the upper area of the nipple air passage, so that formula will not leak out through the passage or collar at this location, and air will effectively pass through the nipple air passage, through the vent tube, and into the bottom of the invented nursing bottle, as during a feeding session.

It should further be commented that since the vent tube is of relatively minor diameter, interiorily, preferably not being any greater than one eighth inch in internal diameter, or even lesser than that, that there are adhesive molecular forces between the liquid and vent that overcome the tendency of the liquid to exit the bottle, and this is due to the critical small diameter of the tube. Also, the adhesive molecule forces hold the liquid until it is returned to the bottle when emptying the container occurs and the vacuum in the container is relieved, so that no leakage occurs. Therefore, when the bottle is inverted, or angularily inverted, as during a feeding session, there will not be much in the way of any residue formula within the vent tube, that can cause any blockage to the passage of ambient air, into the bottle, through the vent tube, to the bottom of the bottle, during its inversion and usage. And, as stated, these types of vent tubes, as explained herein, since they are of minor cost, they can be readily disposable, after each usage, eliminating the need to undertake any cleaning action relative to the vent tube, as it is just thrown away.

It is advantageous and critically important to have the space formed on the superior side of the nipple flange by the additional sealing material at the radial edge so that the particular surface area that is formed again uses adhesive intramolecular forces to hold the liquid until it is returned to the bottle when emptying of the container occurs and the vacuum in the container is relieved, so that no leakage occurs.

Additionally, and preferably, a non-leak feature of this nipple is supplied with its various lengths of slits radially so that flow is adjustable.

These beneficial results from the single vented container or nursing bottle of this invention have long been the primary objective to be obtained from the applicants' various inventions and developments, as some are now patented, relating to this technology.

One of the primary objects of the present invention is to provide for and attain singular venting of a nursing bottle, from a minimum of vent components that may be quickly assembled and located within the nursing bottle, in preparation for consumption of its contents.

A further object of this disclosure is to provide a singular vent that is proportional to the pouring aperture of the nipple of the nursing bottle, or other container, such that full and continuous venting will occur, and all with no aeration of the liquid, no spilling or leaking of the liquid through the vent, and to maintain ambient or positive pressure within the container, regardless of its orientation during application and usage.

A further object of this disclosure is to provide such a single vent that supplies air to the bottom of the liquid container, such as a nursing bottle, during removal of its contents through application.

Still another object of this disclosure is to provide a effective singular vent for a nursing bottle so that no vacuum forms within the container even during usage.

A further object of this disclosure is to provide an easily assembled singular vent structure such that as liquid is removed from the container, on demand, there is an absence of the formation of any vacuum, or lower pressure, within the container during formula consumption.

Still another object of this disclosure is to provide a simple venting structure that accommodates containers of various sizes and designs.

Still another object of the invention is to provide a singular vent for a nursing bottle that may be oriented in any direction and yet obtain venting of its interior to the ambient atmosphere during usage.

Still another object of the disclosure is to provide a singular vent closure, made up of only three parts, that may be used with a nursing bottle oriented in any direction without spillage.

Yet a further principal object of this invention is to provide a singular venting structure for a nursing bottle that has a minimum of assembled components, actually four in number, when prepared and readied for usage.

Yet another object of this invention, in view of the foregoing, is to provide a single venting structure for a nursing bottle that contains the standard bottle nipple, applicable collar, and a singular vent tube that is easily connectable with the nipple, to attain full venting of the interior of the nursing bottle during usage.

Still another object of this disclosure is to provide a singular vent for a container that does not introduce air bubbles into its contained liquid.

Still another object of this invention is to provide for a singular vent that permits the prompt assembly of its components, such as a singular small diameter vent tube, connected to the flange of a nipple, with the nipple being secured to the upper neck of the nursing bottle through the use of its integral collar, all of which are formed of four component parts in their assembly.

Another object of this disclosure is to provide a singular vent that may be easily cleaned after consumption of the contents of its bottle, nursing bottle, or container.

Yet another object of this invention is to provide a singular vent for a container that is simple of construction, and does not include any complex components that are difficult of assembly, or to clean after usage.

Another beneficial object of this invention is to provide such a singular vent that may be easily disassembled and thoroughly cleaned of all of it's deleterious matter or generated bacteria after usage.

Yet another object of this invention is to provide for a single venting structure for a nursing bottle that is made up of no more than its standard components, consisting of the bottle, its nipple, and a collar to hold the same in place, the nipple being custom formed in the manner that accommodates the removable application of the vent tube thereto.

Another favorable object of the current invention is to provide a singular vent that is uncomplicated to manufacture and assemble when prepared for usage within a bottle or container.

Still another object of this invention, as previously explained, is to form the various components of the bottle, its vent tube, and the like, of different colorations, so that these primary colors when the bottle is assembled gives off a third color(s) as an attention attraction to the infant feeding of formula from the same during usage.

Other objects and purposes for the subject matter of this invention may be considered by those skilled in the art upon review of the disclosure as described herein, and upon undertaking a study of the description of its preferred embodiment, in view of the drawings. These, together with other objects of the disclosure, along with the various features of the structure of the singular vent of this invention, are pointed out with particularity in the claims annexed hereto, and forming a part of this disclosure. In accordance with these and other objects, the present invention will now be described with reference to the accompanying drawings.

DESCRIPTION OF THE PREFERRED EMBODIMENT

Figure 1:
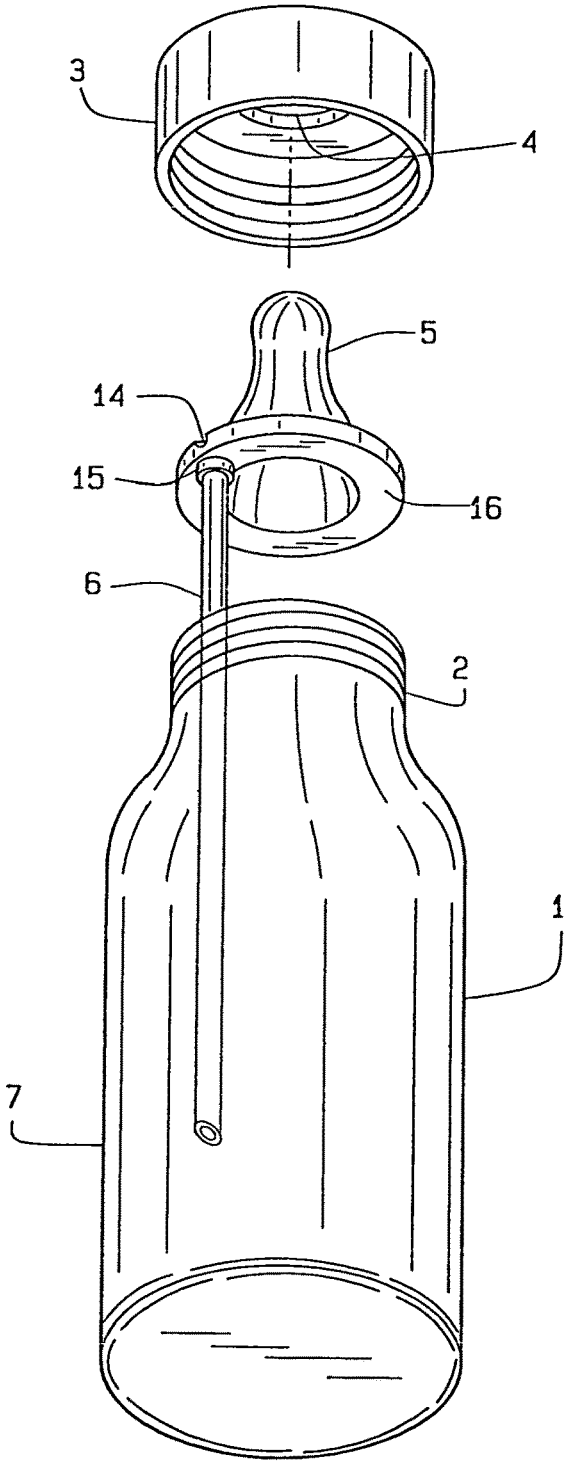
FIG. 1 is an exploded isometric view of the nursing bottle with integrated collar and nipple flange venting structure.

In referring to the drawings, and in particular FIG. 1, therein is shown the bottle or container 1 which in this particular instance, may comprise a regular wide mouth nursing bottle, as noted. It has threads 2, normally, upon its upper neck portion, as shown, and a threaded collar, as at 3, secures onto the threaded neck of the bottle, as can be understood. Usually the collar has an aperture 4 provided therethrough, and it locates the nursing bottle nipple 5 in place, during usage. Usually, when the threaded collar 3 is applied to the threaded neck 2 of the bottle, it provides for a reasonably snug fit of these components, securing the nipple in place, and therein preventing any lateral leakage of formula from the bottom, allowing it primarily to exist from the apertures provided at the upper end of the nipple, as known in the art.

As can be also be seen, internally of the bottle, is a vent tube 6 that extends downwardly into proximity, as at its bottom end 7, towards the bottom of the shown bottle.

Figure 2:
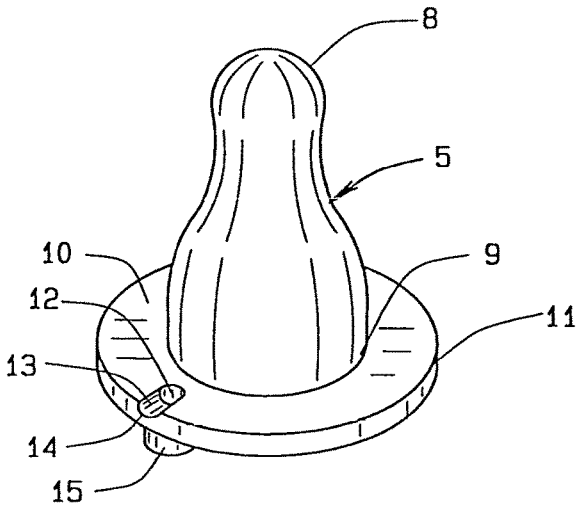
FIG. 2 is an isometric view of the nipple with flange of this invention.

As can also be seen in FIG. 2, the nipple 5 is of a custom design and includes its upright nipple portion 8, while its lower part 9 is integrally formed and molded with a flange 10 that extends radially outwardly from the bottom of the nipple, as can be noted. The flange portion 10 has an integral rim, as at 11, provided around its outer perimeter, and when the collar 3 of the bottle is applied to the threaded neck 2 of the bottle, the collar will seal upon the upper edge of the peripheral flange 11, and to seal the nipple onto the upper edge of the threaded neck 2, as can be understood.

As can further be shown in FIG. 2, there is a vertical like aperture 12 that extends through the flange 10, and opens to the bottom side of the nipple flange, and up to the top side, as can be noted. Then, there is a cut or molded groove 13 that extends radially outwardly of said flange, and through the perimeter flange 11, as noted at 14, and therefore, communicates through said apertures with the interior of the bottle and to the location of the threaded connection between the collar 3, and the threaded neck 2 of the bottle, as can be understood. Thus, these apertures and passages provide communication for air to pass between the interior of the bottle, and to the region between the collar and the threaded neck 2, to allow for venting of air between these locations.

Figure 4:
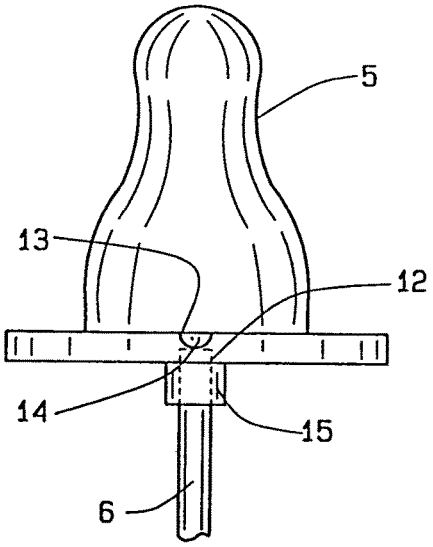
FIG. 4 is a front view of the nipple, with flange and passage, and having an vent tube secured thereto.

As can also be seen in FIG. 4, the bottom of the flange has an integral sleeve 15 molded therewith, and it is provided for accommodating the insertion of said vent tube 6, as previously explained. Thus, when the bottle is in usage, air may be vented from exterior of the bottle, through the region of the threaded connection between the collar 3 and the threaded neck 2 of the bottle, through the various grooves, passages, and apertures 12-14 of the nipple flange and down through the vent tube 6 to the bottom of the bottle, such that when the bottle is used, and inverted, air can be vented into the bottom of the inverted bottle, as desired.

Figure 3:
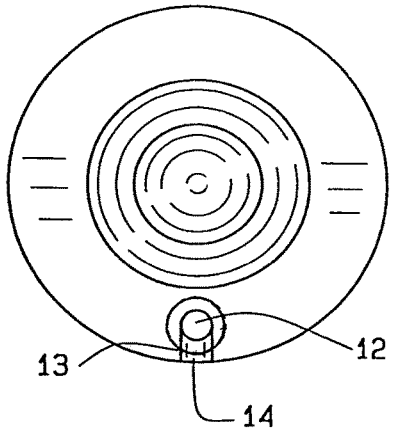
FIG. 3 is a top plan view of the nipple of FIG. 2.

FIG. 3 shows the location of the aperture 12 through the flange, and its grooves, and passages that open at 13 and 14 to the region between the bottle and its collar. As can be noted at the opening 13, this is a tapered flared area provided upon the top side of the shown flange 10, so as to assure that air can enter into and through the passage 14, and attain access into the aperture 12, for providing venting through the vent tube 6, to the bottom of the bottle when it is inverted. This adds extra clearance to the passage of air from the outside, at the region of the collar as it threadily engages upon the neck off the nursing bottle, to attain the entrance of air for venting of the interior of the bottle, when inverted, during drinking.

Hence, through the use of the integral sleeve 15, formed or molded of the nipple 5, and more specifically upon the underside of its flange 10. The vent tube 6 can be easily inserted within the sleeve, and held in position in conjunction with the formed nipple, to provide for that extended venting to the bottom of the nursing bottle, or other container, when it is inverted during usage.

It is just as likely that the groove and passage 14 could be provided radially interiority of the nipple flange 10, so as to provide that direct access through the flange, and to the sleeve held vent tube 6, for venting purposes. This is just an example as to how a simple vent may be provided in conjunction with the structure of the nipple, and its formed flange 10, to furnish singular venting through a vent tube 6, to the interior of the shown nursing bottle, or other container to which it is applied.

Applicants have already reviewed the nature of the structure of the vent tube, or the disposable tube, as noted at 6. It could be formed like a straw, even out of paper, or polymer, and therefore makes it more susceptible of disposability, after a single usage. Or, it can be made of a more hardened polymer, or even glass, which may provide for its reusage and reapplication once it has been cleaned and installed for repeat applications. As stated, the interior of the tube may be formed with an inner opening of approximately one eighth inch, or it may even be reduced in dimensions down to a minimum of 2 mm of internal diameter, in its structure. At these smaller dimensions, for the internal diameter of the vent tube, it will be small enough to prevent liquid form accumulating in the vent tube, and existing the container, during usage. This approximate size allows for the presence of adhesive molecular forces between the liquid and vent that overcome the tendency of the liquid to exit the bottle, and that this is due to the critically small diameter of the tube. Also, the adhesive molecular forces hold the liquid until it is returned to the bottle when emptying the container occurs and the vacuum in the container is relieved, so that no leakage occurs when the bottle is angularly inserted during usage and application. This is a form of capillary action that temporarily adheres the residue liquid within the tube.

Figure 5:
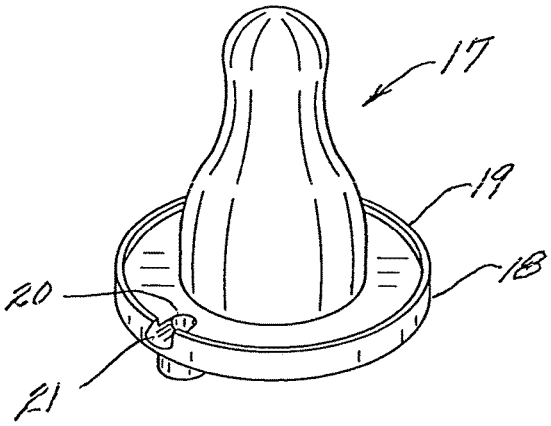
FIG. 5 shows a slightly modified and isometric view of the nipple with perimeter rim.

It is advantageous and critically important to have the space formed on the superior side of the nipple flange, as demonstrated in FIG. 5, by the additional sealing material at the radial edge so that the particular surface area that is formed again uses adhesive intramolecular forces to hold the liquid until it is returned to the bottle when emptying of the container occurs and the vacuum in the container is relieved, so that no leakage occurs.

Additionally, and preferably, a non-leak feature of this nipple is supplied with its various lengths of slits radially so that flow is adjustable, as demonstrated in the oral portion of nipple in FIG. 5.

And, as previously summarized the coloration of these various components may be considered in their initial manufacture. Generally, if the bottle is formed of one primary color, and the vent tube provided therein is of a second primary color, it may be when the vent tube is installed, for usage, it may give a different appearance, which may be a help to educate and excite the young child regarding the generation of multiple color patterns for the bottle structural components, when assembled for usage. A third color may be generated when two colors have been used for forming the bottle and its vent tube. Or, as previously explained, other indicia may be provided upon the vent tube, such as a candy stripe or candy cane appearance, similar to the old barber poles, which may be used to furnish even multiple color patterns for these structural components when assembled into a nursing bottle or other container. Obviously, the nursing bottle will need to be fully or somewhat transparent in its coloration, to allow for viewing of the vent tube therein.

FIG. 5 shows a further isometric view of a somewhat modified nipple design 17 wherein the flange 18 has a peripheral rim 19 provided around it's outer circumference, and the rim extends upwardly for a slight distance, as noted. It may be possible that a similar type rim may be provided to the under surface of the shown flange 18. The purpose of the rim is to provide further surface for the collar of the nursing bottle to biased against, during closure, to assure that a proper seal is made between the collar, the nipple, and the upper rim of the threaded neck 2 of the shown bottle 1 as also noted in FIG. 1. Furthermore, it can be seen that the groove 20 has a flared cut out portion 21 to assure there is sufficient clearance for air to be vented into the bottle, when it is inverted during consumption of its contained formula.

Figure 6:
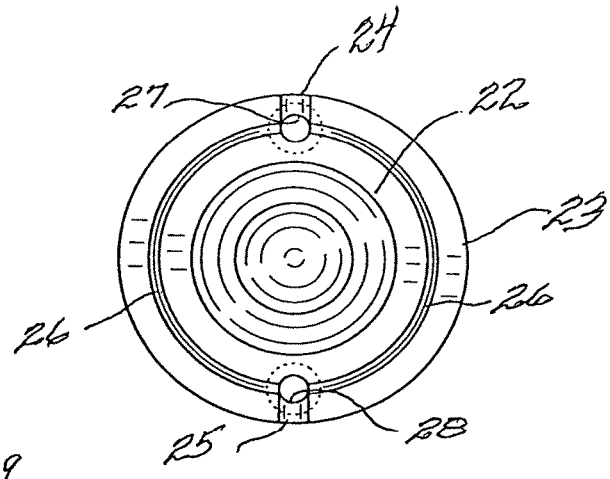
FIG. 6 shows a top plan view of a further modified nipple flange with air vents provided diametrically as noted.

FIG. 6 shows a further modified nipple design, and in this instance, the nipple 22 incorporates its integral flange 23 but in this instance, it has a pair of grooved air venting structures 24 and 25, as previously explained, that are diametrically arranged upon the surface of the flange 23, as can be noted. In addition, there is a circular groove 26 provided around and integrally formed within the upper surface of the flange 23, as noted, and which communicates with the vertical apertures 27 and 28 of the shown flange. Said apertures may be flared to allow entrance of air. Hence, even when the collar 3 is located in position upon the bottle, and threadily engaged therewith, the groove will allow the passage of air along its formed groove 26, to make sure that air is allowed to enter into the bottle, to vent the same, and prevent the formation of that partial vacuum therein, during consumption of it's formula.

Figure 7:
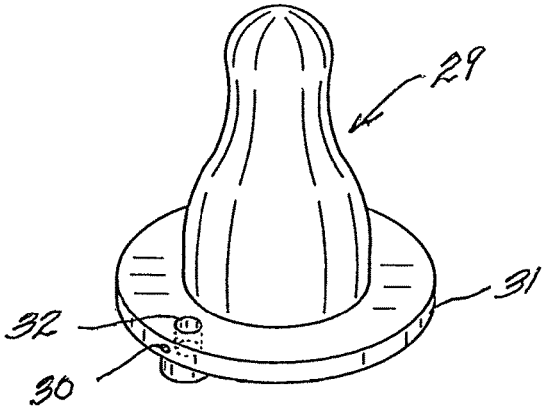
FIG. 7 shows a further modified nipple design where the air vent extends partially through the flange of the nipple.

FIG. 7 shows even a further modification to the nipple design 29 and in this particular instance, instead of using a groove, such as the groove 20 as previously reviewed, there may be an aperture 30 provided through the flange 31, in order to get air to access into the vertical slot 32 and downwardly into the bottle, and through it's vent tube 6, to provide for venting of the interior of the bottle while it's formula or other liquid is being consumed.

These are all shown variations upon just how the vent tube 6 of this invention may engage with the flange of the shown nipples, and to allow for access of air into the bottle, and particularly when the bottle is inverted, to assure that venting occurs, into the bottom of the bottle, as it's contents are being consumed.

Variations or modifications to the subject matter of this invention may occur to those skilled in the art upon review of the development as described herein. Such variations, if within the spirit of this invention, are intended to be encompassed within the scope of any claims to patent protection obtained upon this invention. The definition of the invention as provided in this application, their depiction in the drawings, and their description in the details of the preferred embodiment, are principally set forth for illustrative purposes only.

We claim:

1. A single vented container for use for dispensing of a liquid, said container consisting of a body portion, said body portion being formed of partially or fully transparent material, a collar provided for said container to provide for its closure, a vent tube secured with the collar to provide for venting of the interior of the container to atmosphere, particularly when inverted for dispensing of its contained liquid during usage, said partially or fully transparent container as formed being tinted to a particular first color, the vent tube located within the container being tinted to another color, such that when the vent tube and tinted container are assembled for usage, one or more different colors are generated for the vent tube as can be seen from the exterior of the container during its usage.

2. The single vented container of claim 1, wherein said container is a vented nursing bottle.

3. A single vented container for use for holding a liquid, and for dispensing of the same, said container consisting of a body portion, a neck portion, the neck portion having integral threads, a collar provided for the container, and having internal threads capable of engagement with the neck portion of said container, a nipple provided upon the upper neck portion of the bottle, said nipple having an upstanding dispensing portion, and an integral flange extending radially from the bottom of the nipple, said flange having a vertical aperture extending therethrough, communicating with the interior of the bottle, and said flange having an upper surface, and a flange passage provided upon the upper surface of the flange nipple, communicating with the flange vertical aperture, and extending radially to the perimeter edge of the nipple flange, and communicating with the space between the threads securing the collar to the neck of the bottle, said nipple flange having a lower surface, an integral sleeve provided upon the lower surface of the nipple flange, and said sleeve being in alignment with the vertical aperture through said flange, a vent tube securing with the integral sleeve upon the lower surface of said nipple flange, and said vent tube provided for securing with said integral sleeve for holding the vent tube into position when applied for venting with the single vented container during usage, wherein said container comprises a nursing bottle, and wherein said nipple is a nursing bottle nipple.

4. The single vented nursing bottle of claim 3, wherein the vertical aperture provided within said nipple flange is closed at its upper end.

5. The single vented container of claim 3, wherein the vent tube has an internal channel, and the channel has an internal diameter of approximately 2-3 mm.

6. The single vented nursing bottle of claim 5, wherein said vent tube is disposable.

* * * * *